US009688085B2

(12) United States Patent
Yada et al.

(10) Patent No.: US 9,688,085 B2
(45) Date of Patent: Jun. 27, 2017

(54) PRINTER

(71) Applicant: FUJITSU COMPONENT LIMITED, Tokyo (JP)

(72) Inventors: Yuji Yada, Tokyo (JP); Tetsuhiro Ishikawa, Tokyo (JP); Tatsuya Oguchi, Tokyo (JP); Masahiro Tsuchiya, Tokyo (JP); Sumio Watanabe, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/264,712

(22) Filed: Sep. 14, 2016

(65) Prior Publication Data

US 2017/0080722 A1 Mar. 23, 2017

(30) Foreign Application Priority Data

Sep. 18, 2015 (JP) ..... 2015-185983

(51) Int. Cl.
*B41J 2/15* (2006.01)
*B41J 11/04* (2006.01)
*B41J 2/335* (2006.01)

(52) U.S. Cl.
CPC ..... *B41J 11/04* (2013.01); *B41J 2/335* (2013.01)

(58) Field of Classification Search
CPC ... B41J 2/32; B41J 29/13; B41J 15/042; B41J 17/32; B41J 32/00; B41J 35/28
See application file for complete search history.

(56) References Cited

U.S. PATENT DOCUMENTS

| | | | | |
|---|---|---|---|---|
| 6,744,457 | B2 | 6/2004 | Seino et al. | |
| 7,806,361 | B2 | 10/2010 | Sato et al. | |
| 8,159,514 | B2 * | 4/2012 | Takizawa | B41J 2/325 347/215 |
| 8,585,304 | B2 | 11/2013 | Yokoyama | |
| 8,896,646 | B2 * | 11/2014 | Inoue | B41J 11/70 347/197 |

FOREIGN PATENT DOCUMENTS

| | | |
|---|---|---|
| JP | H02-1620558 | 6/1990 |
| JP | 2003-246104 | 9/2003 |
| JP | 2008-143004 | 6/2008 |
| JP | 2009-028910 | 2/2009 |

* cited by examiner

*Primary Examiner* — Lamson Nguyen
(74) *Attorney, Agent, or Firm* — IPUSA, PLLC

(57) ABSTRACT

A printer configured to perform printing on recording paper includes a body and a lid. The body includes a holder configured to accommodate the recording paper. The lid is attached to the body to be opened and closed relative to the body. An opening is formed at the bottom of the holder to allow attachment of a function module to the bottom of the holder.

10 Claims, 8 Drawing Sheets

PRINTER

CROSS-REFERENCE TO RELATED APPLICATION

The present application is based upon and claims the benefit of priority of Japanese Patent Application No. 2015-185983, filed on Sep. 18, 2015, the entire contents of which are incorporated herein by reference.

BACKGROUND OF THE INVENTION

1. Field of the Invention

The present invention relates to printers.

2. Description of the Related Art

Printers that output receipts are widely used for shop registers and automated teller machines (ATMs) or cash dispensers (CDs) in banks. Such printers that output receipts perform printing on recording paper such as thermal paper with a head while conveying the recording paper, and after conveying the recording paper, cuts the recording paper with a cutter. The cutter includes a fixed blade and a movable blade. The movable blade slides toward the fixed blade to cut the recording paper between the movable blade and the fixed blade.

Such printers include a printer body and a lid pivotably supported on the printer body. The lid is opened to allow a roll of recording paper to be loaded into a paper holder of the printer body.

Reference may be made to, for example, Japanese Patent No. 2585769 and Japanese Laid-Open Patent Applications No. 2003-246104, No. 2009-28910, and No. 2008-143004 for related art.

SUMMARY OF THE INVENTION

According to an aspect of the present invention, a printer configured to perform printing on recording paper includes a body and a lid. The body includes a holder configured to accommodate the recording paper. The lid is attached to the body to be opened and closed relative to the body. An opening is formed at the bottom of the holder to allow attachment of a function module to the bottom of the holder.

DESCRIPTION OF THE EMBODIMENTS

Figure 1:
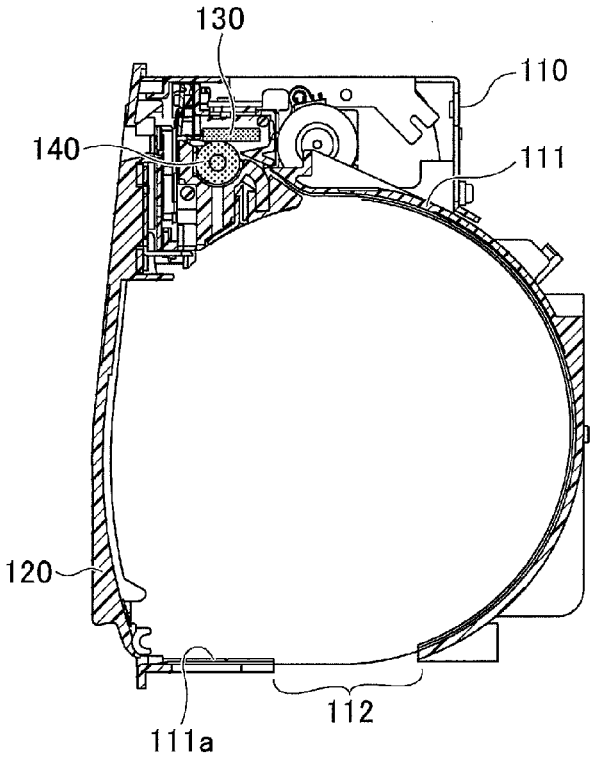
FIG. 1 is a cross-sectional view of a printer according to an embodiment.

As described above, there are printers whose lid is opened to allow a roll of recording paper to be loaded into a paper holder. Such printers include drop-type printers into which a roll of recording paper is dropped and loaded without using a paper feed shaft. The drop-type printers are highly convenient because of the ease of loading recording paper.

Furthermore, printers are used for various purposes. Therefore, it is desired that printers be suitably configured purpose by purpose. For example, when a component attached to the interior of a recording paper holder for loading recording paper differs between printers, printers are designed and manufactured separately for each different configuration, thus increasing the manufacturing costs of the printers. Accordingly, there is a demand for printers that can be manufactured at low cost even in the case of manufacturing printers having different configurations, that is, the case of high-variety, low-volume manufacturing of printers.

According to an aspect of the present invention, it is possible to manufacture printers having different configurations at low cost.

An embodiment of the present invention is described below. In the following description, the same member or element is referred to using the same reference numeral, and is not repetitively described.

A printer according to this embodiment is described with reference to FIGS. 1 through 4E. The printer of this embodiment is referred to as a clamshell printer, in which a roll of recording paper is dropped and loaded into a paper holder. Function modules depicted in FIGS. 4A through 4E are attachable to the printer of this embodiment.

Figure 2:
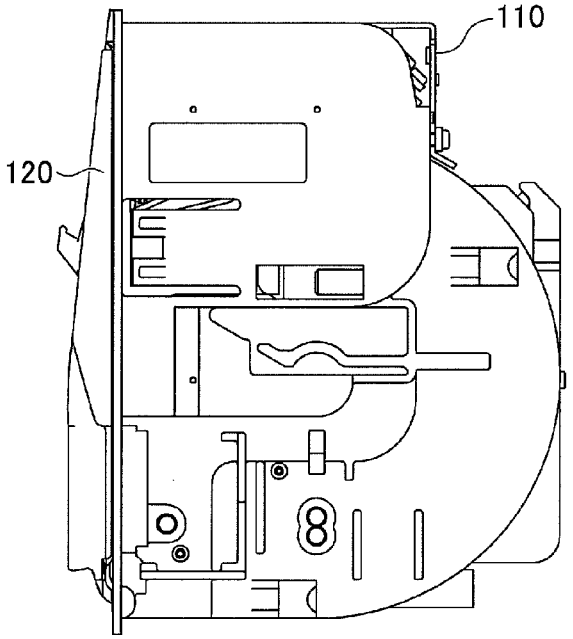
FIG. 2 is a side view of the printer according to the embodiment.
Figure 3:
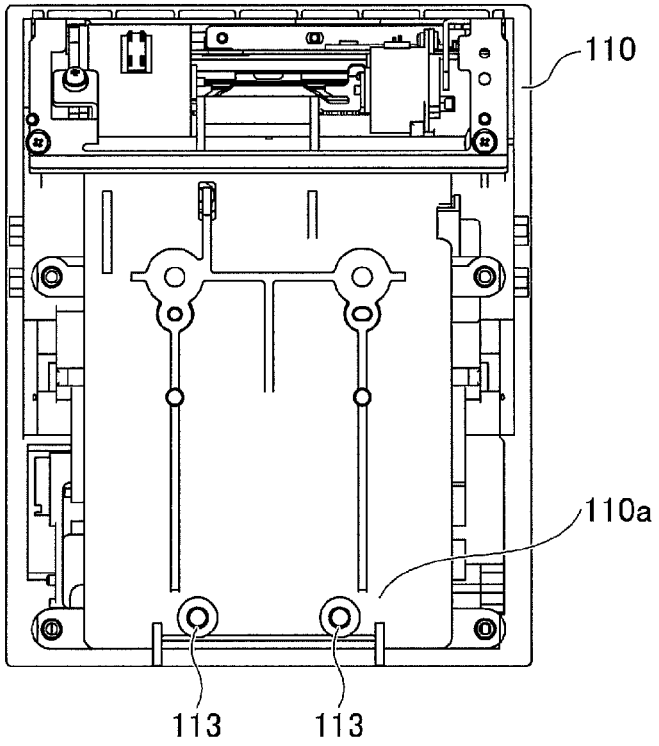
FIG. 3 is a rear view of the printer according to the embodiment.

FIGS. 1, 2 and 3 are a cross-sectional view, a side view, and a rear view, respectively, of the printer. Referring to FIGS. 1 through 3, the printer includes a body 110 and a lid 120 attached to the body 110. The lid 120 is pivotable about a shaft to be opened and closed relative to the body 110.

The body 110 includes a recording paper holder 111 ("holder 111"), a print head 130 ("head 130") for printing on recording paper, a fixed blade, a control circuit board, and motors. The head 130 is a thermal head. The inside of the holder 111 is shaped to accommodate a roll of recording paper. The control circuit board is provided to control the printer. The motors are a motor for conveying recording paper and a motor for driving a movable blade. A platen roller 140 and the movable blade are attached to the lid 120. Alternatively, the platen roller 140 may be provided in the body 110, and the head 130 may be attached to the lid 120.

The printer performs printing on recording paper held between the head 130 and the platen roller 140. That is, the platen roller 140 rotates to convey recording paper, and the recording paper is subjected to printing by the head 130 while being conveyed.

Referring to FIG. 1, an opening 112 is formed at a bottom 111*a* of the holder 111. Various function modules having different functions may be attached one at a time to the bottom 111*a* at the opening 112 in accordance with the purpose of use of the printer. Printers having different functions can be manufactured at low cost by thus attaching various function modules having different functions one at a time to the bottom 111*a* of the holder 111 at the opening 112. Referring to FIG. 3, attachment holes 113 for fastening a function module attached to the bottom 111*a* at the opening 112 to the body 111 from its external side are formed in a rear part 110*a* of the body 110. The rear part 110*a* of the body 110 is on the opposite side of an internal space of the holder 111 for loading a roll of recording paper from the closed lid 120. The function module may be fastened to the body 111 with fasteners such as screws inserted through the attachment holes 113.

Thus, according to this embodiment, the opening 112 is thus formed at the bottom 111*a* of the holder 111 as depicted in FIG. 1 to allow the printer to serve as a common base for printers having different functions, which are manufactured by attaching a function module to the bottom 111*a* at the opening 112 in accordance with their purposes of use. Thus, it is possible to manufacture printers having different functions at low cost.

FIGS. 4A through 4E are diagrams depicting examples of function modules attachable to the bottom 111*a* at the opening 112. The function modules depicted in FIGS. 4A through 4E may be attached to the bottom 111*a* at the opening 112 and fixed using screws 201.

Figure 4A:
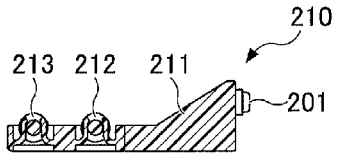
FIGS. 4A through 4E are diagrams depicting function modules attachable to the printer according to the embodiment.

FIG. 4A depicts a roller module 210. The roller module 210 includes a module body 211 and conveyance assist rollers 212 and 213 provided on the module body 211.

Figure 4B:
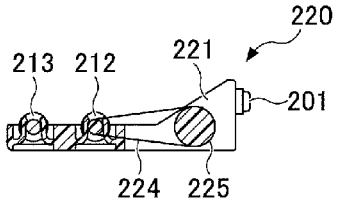

FIG. 4B depicts a damper module 220. The damper module 220 includes a module body 221, the conveyance assist rollers 212 and 213 provided on the module body 221, and a torque limiter 225 connected to the conveyance assist roller 212 via a belt 224. The torque limiter 225 serves as a rotation control part to control the rotation of the conveyance assist roller 212. The rotation control part, however, is not limited to the torque limiter 225, and other components capable of controlling the rotation of the conveyance assist roller 212 may serve as the rotation control part.

Figure 4C:
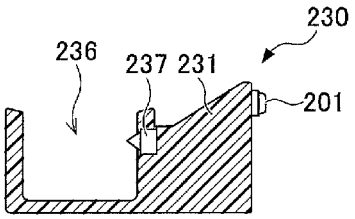

FIG. 4C depicts a near-end module 230. The near-end module 230 is configured to detect a near-end state of recording paper where the recording paper is near its end and is running out. The near-end module 230 includes a module body 231, a roll holder 236 hollowed out in the module body 231, and a detection sensor 237. The roll holder 236 is configured to accommodate a roll of recording paper when the roll becomes smaller in diameter. The detection sensor 237 detects the roll of recording paper accommodated in the roll holder 236. The detection sensor 237 may be either a mechanical sensor configured to detect the roll by contacting the roll, such as a switch, or an optical sensor configured to detect the roll without contacting the roll.

Figure 4D:
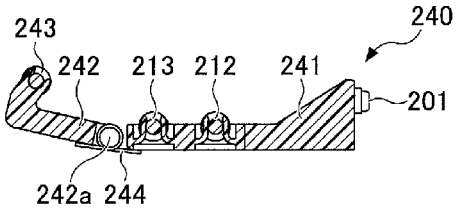

FIG. 4D depicts a roll-out prevention module 240. The roll-out prevention module 240 includes a module body 241, the conveyance assist rollers 212 and 213 provided on the module body 241, an arm 242 pivotable about a shaft 242*a*, a contact roller 243 attached to an end of the arm 242, and a spring 244 attached to a portion of the module body 241 near the shaft 242*a*. The module body 241 is configured to prevent a roll of recording paper from moving (rolling) out of the holder 111.

Figure 4E:
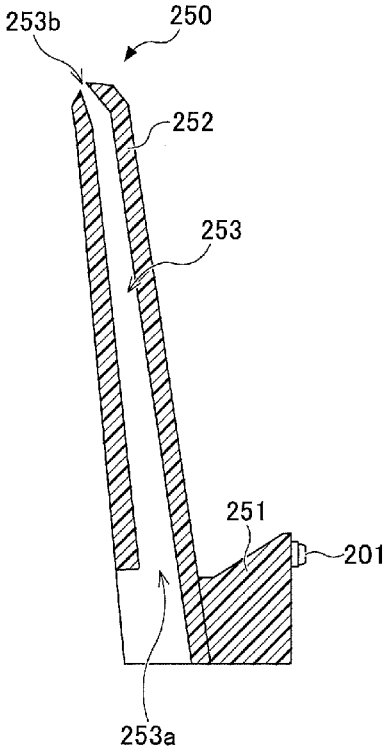

FIG. 4E depicts a paper guide module 250. The paper guide module 250 includes a module body 251 and a guide 252 provided on the module body 251. The module body 251 is configured to introduce recording paper into the guide 252 from outside the holder 111. The guide 252 is elongated to guide the introduced recording paper to a nip between the head 130 and the platen roller 140. A paper path 253 is formed in the guide 252. The recording paper is introduced into the paper path through an entrance 253*a* of the paper path 253, and passes through the paper path 253 to be discharged from an exit 253*b* of the paper path 253.

Printers having different functions manufactured by attaching the function modules 210 through 250 depicted in FIGS. 4A through 4E to the printer depicted in FIGS. 1 through 3 are described below in order.

Figure 5:
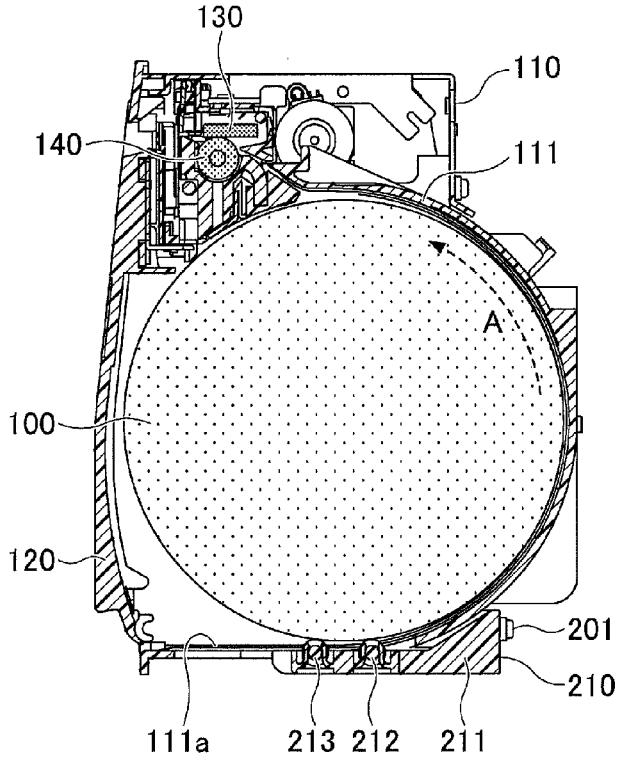
FIG. 5 is a diagram depicting the printer to which a roller module is attached.

FIG. 5 is a diagram depicting a printer where the roller module 210 depicted in FIG. 4A is attached to the bottom 111*a* at the opening 112. The roller module 210 is attached from outside the holder 111 to expose the conveyance assist rollers 212 and 213 to the interior of the holder 111 at the opening 112. The roller module 210 is fixed to the body 110 by being screwed to the attachment holes 113 formed in the rear part 110*a* of the body 110 using the screws 201.

The roller module 210 is thus attached to cause a roll of recording paper 100 to be placed on the conveyance assist rollers 212 and 213 so that the conveyance assist rollers 212 and 213 contact the peripheral surface of the roll of recording paper 100, when the roll of recording paper 100 is loaded and accommodated in the holder 111. Accordingly, when the recording paper 100 rotates counterclockwise as indicated by the dashed arrow A while being subjected to printing by the head 130, the conveyance assist rollers 212 and 213 also rotate in accordance with the rotation of the recording paper 100. Therefore, the friction between the recording paper 100 and the interior surface of the holder 111 is reduced to prevent the recording paper 100 from discoloring or being damaged.

Without the conveyance assist rollers 212 and 213, the recording paper 100, which is thermal paper, may be discolored by the heat generated by the friction between the rotating recording paper 100 and the holder 111 contacting the recording paper 100 when the recording paper 100 rotates. By attaching the roller module 210 including the conveyance assist rollers 212 and 213, however, the friction of the recording paper 100 is reduced, so that it is possible to prevent the discoloration of the recording paper 100.

Figure 6:
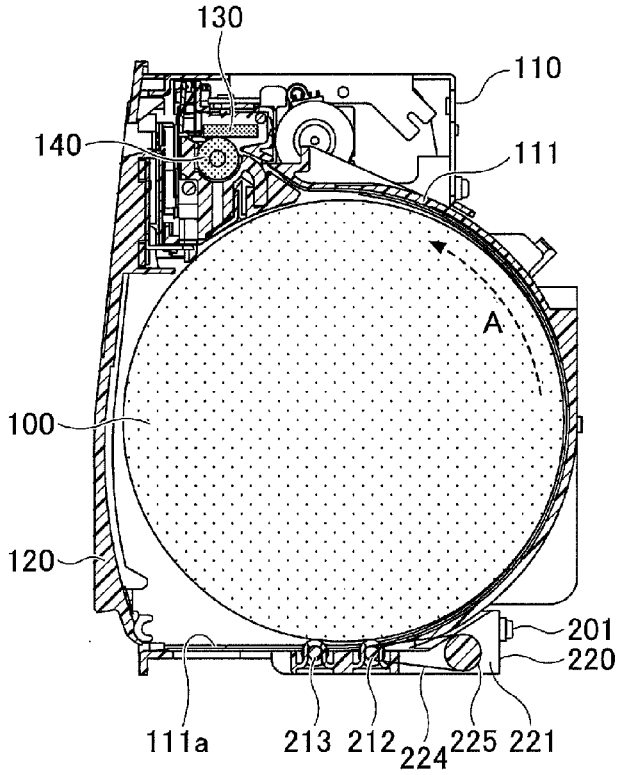
FIG. 6 is a diagram depicting the printer to which a damper module is attached.

FIG. 6 is a diagram depicting a printer where the damper module 220 depicted in FIG. 4B is attached to the bottom 111*a* at the opening 112. The damper module 220 is attached from outside the holder 111 to expose the conveyance assist rollers 212 and 213 to the interior of the holder 111 at the opening 112. The damper module 220 is fixed to the body 110 by being screwed to the attachment holes 113 formed in the rear part 110*a* of the body 110 using the screws 201.

The damper module 220 is attached to cause the roll of recording paper 100 to be placed on the conveyance assist rollers 212 and 213 so that the conveyance assist rollers 212 and 213 contact the peripheral surface of the roll of recording paper 100, when the roll of recording paper 100 is loaded and accommodated in the holder 111. Accordingly, when the recording paper 100 rotates counterclockwise as indicated by the dashed arrow A, the conveyance assist rollers 212 and 213 also rotate in accordance with the rotation of the recording paper 100.

When the head 130 ends printing, the platen roller 140 stops rotating to stop conveying the recording paper 100. If the recording paper 100 or the conveyance assist roller 212 or 213 continues to rotate by inertia thereafter, however, the recording paper 100 in the holder 111 slacks.

Therefore, according to the damper module 220, the torque limiter 225 is connected to the conveyance assist roller 212 via the belt 224 to reduce the inertial rotation of the conveyance assist roller 212. As a result, the recording paper 100 contacting the conveyance assist roller 212 is prevented from continuing to rotate after the platen roller 140 stops conveying the recording paper 100, so that it is possible to prevent the recording paper 100 from becoming slack.

Figure 7:
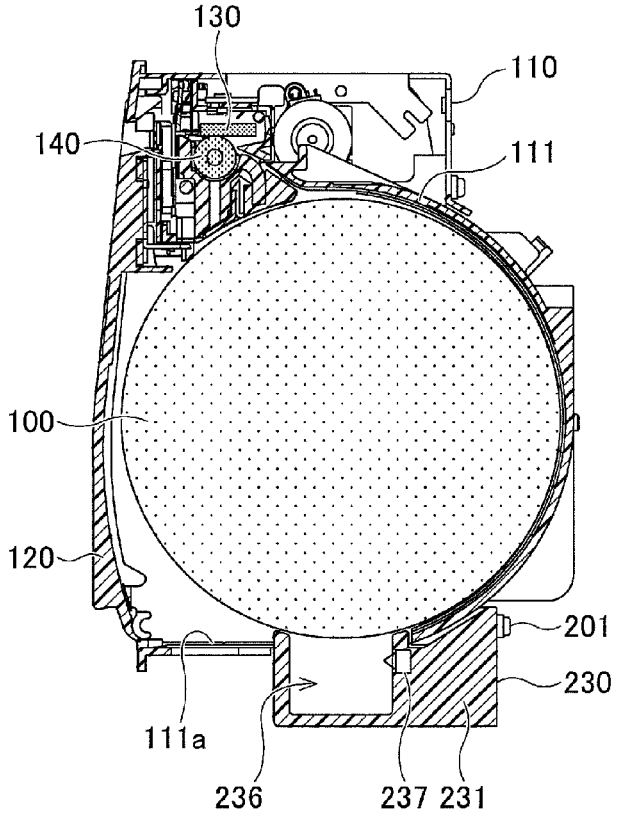
FIG. 7 is a diagram depicting the printer to which a near-end module is attached.
Figure 8:
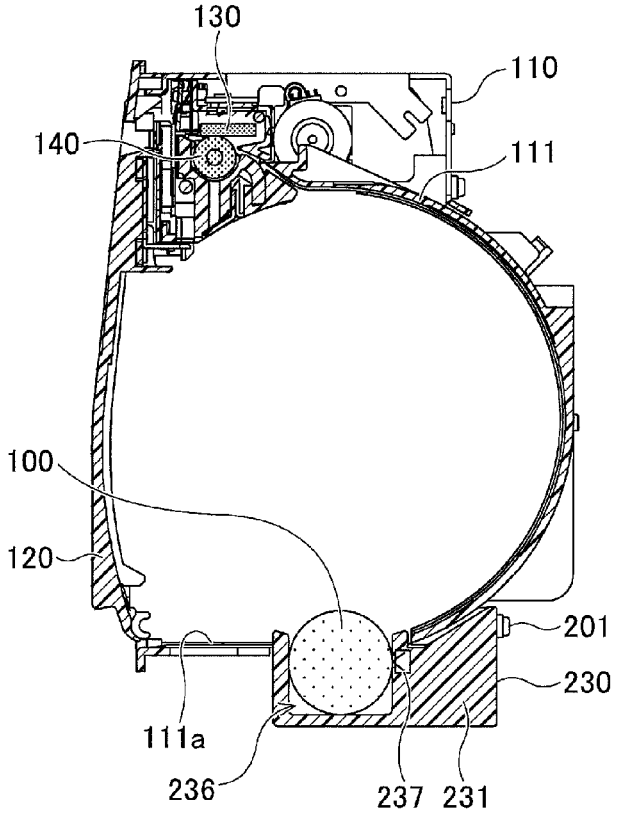
FIG. 8 is a diagram depicting the printer to which the near-end module is attached.

FIGS. 7 and 8 are diagrams depicting a printer where the near-end module 230 depicted in FIG. 4C is attached to the bottom 111*a* at the opening 112. The near-end module 230 is attached from outside the holder 111 to position the roll holder 236 at the opening 112. The near-end module 230 is fixed to the body 110 by being screwed to the attachment holes 113 formed in the rear part 110*a* of the body 110 using the screws 201.

At first, the roll of recording paper 100 accommodated in the holder 111 has a large diameter as depicted in FIG. 7, and is therefore prevented from entering the roll holder 236. The diameter of the roll of recording paper 100, however, gradually decreases as the recording paper 100 is subjected to printing. When the end of the recording paper 100 is near, the roll becomes so small as to enter the roll holder 236 as depicted in FIG. 8. Thus, when the diameter of the roll of recording paper 100 becomes small, the roll enters the roll holder 236 so that the recording paper 100 is detected with the detection sensor 237 provided in the roll holder 236. Accordingly, it is possible to detect the near-end state of the recording paper 100.

Figure 9:
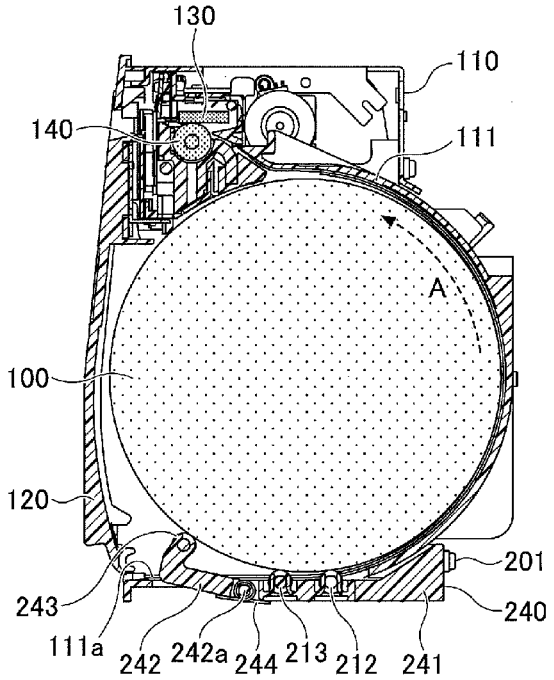
FIG. 9 is a diagram depicting the printer to which a roll-out prevention module is attached.
Figure 10:
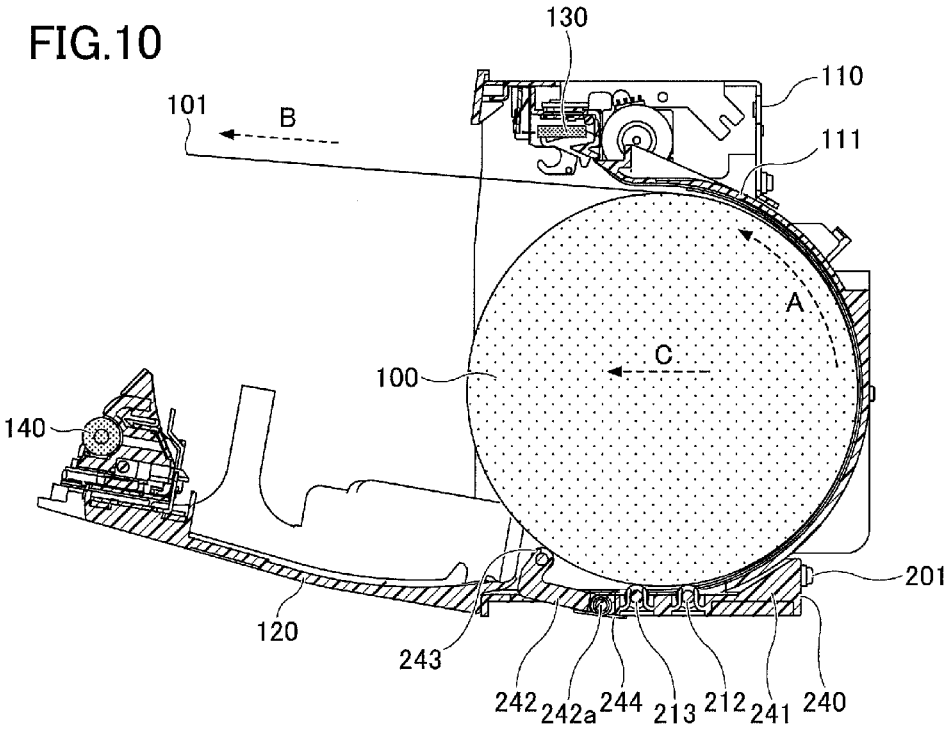
FIG. 10 is a diagram depicting the printer to which the roll-out prevention module is attached.
Figure 11:
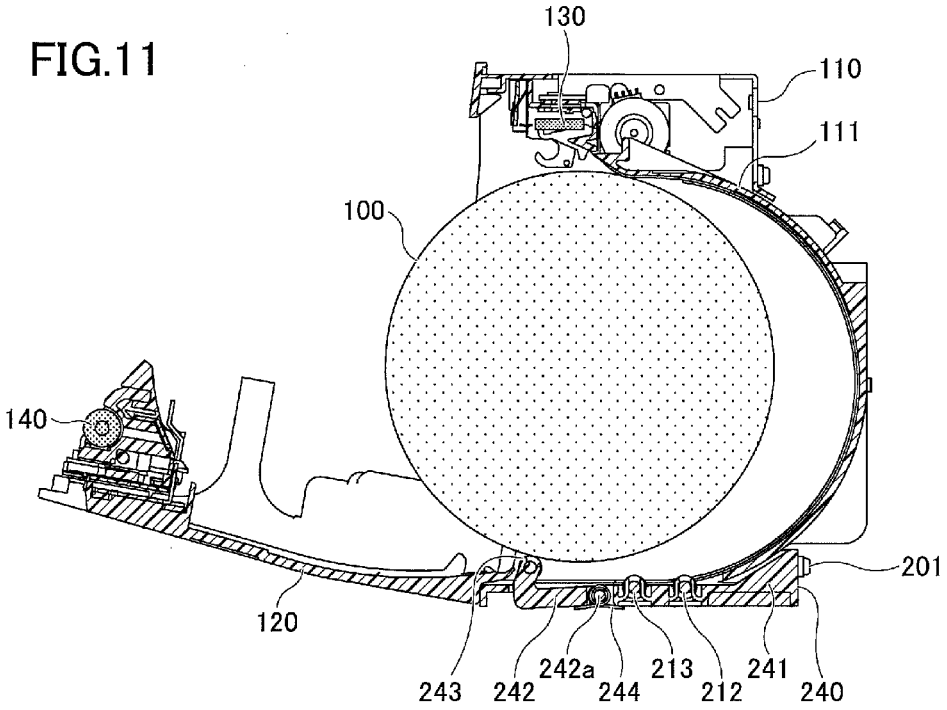
FIG. 11 is a diagram depicting the printer to which the roll-out prevention module is attached.

FIGS. 9 through 11 are diagrams depicting a printer where the roll-out prevention module 240 depicted in FIG. 4D is attached to the bottom 111*a* at the opening 112. The roll-out prevention module 240 is attached from outside the holder 111 to position the conveyance assist rollers 212 and 213 and the arm 242 at the opening 112. The roll-out prevention module 240 is fixed to the body 110 by being screwed to the attachment holes 113 formed in the rear part 110*a* of the body 110 using the screws 201.

According to the printer to which the roll-out prevention module 240 is attached, the arm 242 is positioned between the recording paper 100 and the lid 120 when the recording paper 100 is loaded in the holder 111. A first end of the arm 242 is supported on the shaft 242*a* to be pivotable about the shaft 242*a*. A contact roller 243 protruding toward the recording paper 100 inside the holder 111 is provided on a portion of the arm 242 near its second end, which is closer to the lid 120 than the first end.

When the roll of recording paper 100 is loaded and accommodated in the holder 111, the contact roller 243 contacts the peripheral surface of the recording paper 100. The spring 244 is attached to a portion of the arm 242 near its first end. The spring 244 urges the contact roller 243 to press the recording paper 100 upward. The contact roller 243 is rotatably attached to the arm 242. When the recording paper 100 rotates, the contact roller 243 contacting the recording paper 100 also rotates with the rotation of the recording paper 100.

Furthermore, according to the roll-out prevention module 240, the conveyance assist rollers 212 and 213 are provided in a part corresponding to the bottom 111*a* of the holder 111, so that the roll of recording paper 100 is loaded onto the conveyance assist rollers 212 and 213.

When the lid 120 is closed, that is, when the recording paper 100 is ready to be subjected to printing, an end (leading edge) 101 of the recording paper 100 is held between the head 130 and the platen roller 140. Accordingly, after the recording paper 100 is loaded into the holder 111, the end 101 of the recording paper 100 is pulled out by a certain length in the direction indicated by the dashed arrow B in FIG. 10 before the lid 120 is closed. When the end 101 of the recording paper 100 is thus pulled out in the direction indicated by the dashed arrow B, the roll of recording paper 100 rotates in the counterclockwise direction indicated by the dashed arrow A, and a force is exerted on the roll of recording paper 100 in the direction indicated by the dashed arrow C in FIG. 10.

According to the printer to which the roll-out prevention module 240 is attached, however, the contact roller 243 is provided on the arm 242 to contact the peripheral surface of the recording paper 100. Therefore, the contact roller 243 prevents the recording paper 100 from moving in the direction indicated by the dashed arrow C to prevent the recording paper 100 from rolling out toward the lid 120. The contact roller 243 is pressed toward the recording paper 100 by the spring 244. Therefore, when a force in the direction indicated by the dashed arrow C is applied to the recording paper 100, the recording paper 100 is prevented from rolling out toward the lid 120.

Furthermore, according to the roll-out prevention module 240, the conveyance assist rollers 212 and 213 are provided in a part corresponding to the bottom 111*a* of the holder 111. Accordingly, when the end 101 of the recording paper 100 is pulled out in the direction indicated by the dashed arrow B to rotate the recording paper 100 in the counterclockwise direction indicated by the dashed arrow A, the conveyance assist rollers 212 and 213 contacting the recording paper 100 also rotate in response to the rotation of the recording paper 100. Therefore, the force exerted on the recording paper 100 in the direction indicated by the dashed arrow C is attenuated. Thus, the recording paper 100 is prevented from rolling out of the holder 111 when the end 101 of the recording paper 100 is pulled out.

Next, a process of loading the recording paper 100 into the holder 111 of the printer to which the roll-out prevention module 240 is attached is described with reference to FIG. 11. When the recording paper 100 is loaded into the printer, the lid 120 is opened, and the recording paper 100 is loaded over the lid 120 into the holder 111 through a space created by the opened lid 120. Specifically, in the process of loading the recording paper 100 into the holder 111, the recording paper 100 is loaded into the holder 111 from the side of an end of the opened lid 120 at which the platen roller 140 is provided.

Thus, when the recording paper 100 is loaded into the holder 111, as depicted in FIG. 11, the recording paper 100 gets on the contact roller 243 to press the contact roller 243 with the weight of the recording paper 100, so that the arm 242 pivots counterclockwise about the shaft 242*a* against the restoring force of the spring 244 to move downward. As a result, the position of the contact roller 243 is lowered. Furthermore, the contact roller 243 rotates when the recording paper 100 enters the holder 111. Accordingly, the recording paper 100 can be smoothly loaded into the holder 111.

Figure 12:
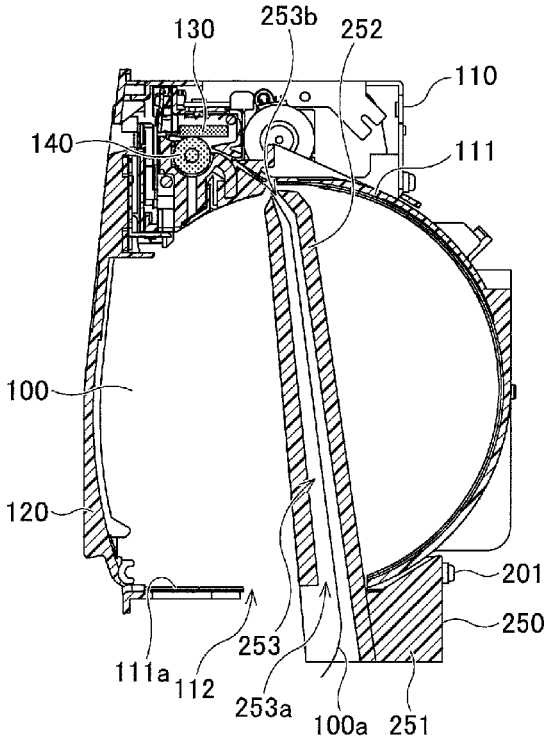
FIG. 12 is a diagram depicting the printer to which a paper guide module is attached.

FIG. 12 is a diagram depicting a printer where the paper guide module 250 depicted in FIG. 4E is attached to the bottom 111*a* at the opening 112. The paper guide module 250 is attached from outside the holder 111 so that the guide 252 is positioned inside the holder 111 with the exit 253*b* of the paper path 253 near the nip between the head 130 and the platen roller 140. The paper guide module 250 is fixed to the body 110 by being screwed to the attachment holes 113 formed in the rear part 110*a* of the body 110 using the screws 201.

The paper guide module 250 is used to set recording paper when the roll of recording paper is too large in diameter to be loaded into the holder 111 or a sheet of paper that is not rolled and is unloadable into the holder 111 is used as recording paper.

According to the printer to which the paper guide module 250 is attached, recording paper 100*a* is fed through the paper path 253 inside the guide 252 from outside the printer. More specifically, the recording paper 100*a* enters the paper path 253 through the entrance 253*a* to pass through the paper path 253 and exits the paper path 253 through the exit 253*b*. The recording paper 100*a* exiting through the exit 253*b* is fed to the nip between the head 130 and the platen roller 140 to be subjected to printing by the head 130.

Figure 13:
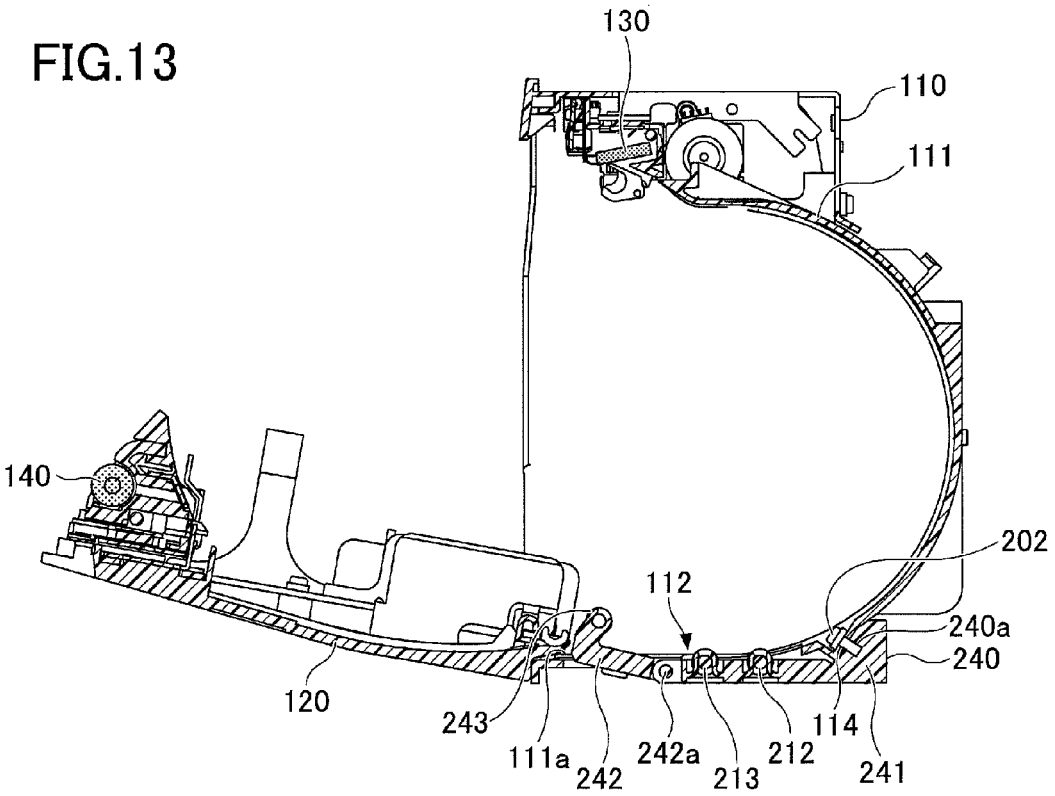
FIG. 13 is a diagram illustrating a method of attaching a function module to the printer.

The above description is given of the case of fixing the individual function modules to the printer depicted in FIGS. 1 through 3 from inside the printer with the screws 201. Alternatively, for example, the individual function modules may be fixed to the body 110 of the printer from inside the printer with screws 202 as depicted in FIG. 13. By way of example, FIG. 13 depicts the printer to which the roll-out prevention module 240 is attached. For example, the roll-out prevention module 240 is inserted through the opening 112 from inside the printer, attached to the bottom 111*a* at the opening 112, and fastened to the body 110 with the screws 202 inserted into screw holes 240*a* of the roll-out prevention module 240 through attachment holes 114 formed in a lower portion of the holder 111. The other function modules may also be attached to the printer in the same manner.

When the printer is incorporated in an information terminal apparatus, there is no work space for screwing a function module to the printer from outside the printer. Therefore, it may be difficult to attach a function module to the printer from outside the printer. According to this embodiment, it is possible to screw a function module to the printer from inside the printer. Accordingly, even when the printer is incorporated in an information terminal apparatus, it is possible to easily attach a function module to the printer.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer configured to perform printing on recording paper, the printer comprising:

a body including a holder configured to accommodate the recording paper; and a lid attached to the body to be opened and closed relative to the body, wherein an opening is formed at a bottom of the holder to allow attachment of a function module to the bottom of the holder.

2. The printer as claimed in claim 1, further comprising:

a platen roller attached to one of the body and the lid; and a print head attached to the other of the body and the lid.

3. The printer as claimed in claim 2, further comprising:

the function module, the function module including a guide configured to feed the recording paper from outside the holder to a nip between the platen roller and the print head.

4. The printer as claimed in claim 1, further comprising:

the function module, the function module including a roller that contacts a peripheral surface of a roll of the recording paper when the roll of the recording paper is accommodated in the holder.

5. The printer as claimed in claim 4, wherein the function module further includes a rotation control part configured to control rotation of the roller.

6. The printer as claimed in claim 1, further comprising:

the function module, the function module including a hollowed roller holder configured to accommodate a roll of the recording paper when a diameter of the roll of the recording paper accommodated in the holder is reduced; and a sensor configured to detect the roll of the recording paper accommodated in the hollowed roller holder.

7. The printer as claimed in claim 1, further comprising:

the function module, the function module including a pivotable arm, wherein the pivotable arm includes a roller urged toward an internal space of the holder to contact a peripheral surface of a roll of the recording paper when the roll of the recording paper is accommodated in the internal space of the holder.

8. The printer as claimed in claim 1, further comprising:

the function module, the function module being attached to the bottom of the holder at the opening and fastened to the holder.

9. The printer as claimed in claim 8, wherein the function module is screwed to holes formed in the holder.

10. The printer as claimed in claim 8, wherein the function module is fastened to a part of the holder on an opposite side of the opening from the lid.

* * * * *